US005675346A

United States Patent [19]

Nishikawa et al.

[11] Patent Number: 5,675,346

[45] Date of Patent: Oct. 7, 1997

[54] ANNULAR MICROSTRIP ANTENNA ELEMENT AND RADIAL LINE ANTENNA SYSTEM EMPLOYING THE SAME

[75] Inventors: Kunitoshi Nishikawa, Gifu-ken; Toshiaki Watanabe, Owariasahi; Masaru Ogawa, Aichi-ken; Tomohisa Harada, Aichi-ken, all of Japan

[73] Assignee: Kabushiki Kaisha Toyota Chuo Kenkyusho, Aichi-ken, Japan

[21] Appl. No.: 618,822

[22] Filed: Mar. 20, 1996

[30] Foreign Application Priority Data

Mar. 23, 1995 [JP] Japan ..... 7-064275

[51] Int. Cl.[6] ..... H01Q 1/38

[52] U.S. Cl. ..... 343/700 MS; 343/769

[58] Field of Search ..... 343/700 MS, 742, 343/744, 769

[56] References Cited

U.S. PATENT DOCUMENTS

| | | | |
|---|---|---|---|
| 4,987,421 | 1/1991 | Sunahara et al. | 343/700 MS |
| 4,994,820 | 2/1991 | Suzuki et al. | 343/700 MS X |
| 5,548,297 | 8/1996 | Arai | 343/700 MS |

FOREIGN PATENT DOCUMENTS

| | | | |
|---|---|---|---|
| 58-77306 | 5/1983 | Japan | 343/700 MS |
| 8141006 | 8/1983 | Japan | 343/700 MS |
| 2-108307 | 4/1990 | Japan . | |
| 2-113605 | 4/1990 | Japan . | |

*Primary Examiner*—Hoanganh T. Le
*Assistant Examiner*—Tho Phan
*Attorney, Agent, or Firm*—Oblon, Spivak, McClelland, Maier & Neustadt, P.C.

[57] ABSTRACT

In an annular microstrip antenna element, an annular radiant conductor plate is mounted on a ground conductor plate via a dielectric layer. A coaxial transmission line is provided, whose external conductor is connected to the ground conductor plate, and whose central conductor is connected to the radiant conductor plate, via a feeding point, with a pair of microstrip lines. The pair of microstrip lines extend from the feeding point to two connecting points on the radiant conductor plate, forming an angle between them like a V shape. By varying the angle, it is possible to adjust the input impedance of the annular microstrip antenna element at the feeding point, so that impedance matching with the coaxial transmission line is achieved. In a radial line antenna system comprising a plurality of the antenna elements, the antenna elements are mounted on concentric circles with a constant space between the adjacent antenna elements, thereby reducing undesirable electromagnetic coupling.

11 Claims, 10 Drawing Sheets

ANNULAR MICROSTRIP ANTENNA ELEMENT AND RADIAL LINE ANTENNA SYSTEM EMPLOYING THE SAME

BACKGROUND OF THE INVENTION

1. Field of the Invention

This invention relates to an annular microstrip antenna element and an antenna system employing the antenna element, for use in a satellite communication and the like.

2. Description of the Related Art

Conventionally, an array antenna system employing a plurality of microstrip antenna elements has been used as an antenna for a satellite communication, which requires a high sensitivity.

Japanese Patent Application Laid-Open No. Hei 2-108307 proposes a microstrip antenna element using an annular radiant conductor. The antenna element includes, as shown in FIGS. 10A and 10B, a dielectric plate 1, a ground conductor plate 2, an annular radiant conductor plate 3, a coaxial transmission line 4, a matching circuit 5 comprising a microstrip line, and a circular conductor plate 6 incorporated in the dielectric plate 1. The coaxial transmission line 4 includes a central conductor 4*a* and an external conductor 4*b*. The central conductor 4*a* is connected to the annular radiant conductor plate 3 via the matching circuit 5, while the external conductor 4*b* is connected to the ground conductor plate 2 and the circular conductor plate 6.

By employing an annular radiant conductor plate 3, it is possible to obtain the same resonance frequency with a smaller antenna element, compared to the case when employing a circular antenna element. Moreover, it is possible to achieve an array antenna comprising a plurality of the annular antenna elements, in which coupling among adjacent antenna elements is reduced.

In such an antenna element, the input impedance thereof is higher than the impedance of an coaxial transmission line, which is generally used as a transmission line, the latter impedance being 50Ω or 75Ω. Because of the difference in impedance, a conventional antenna element, as described above, generally includes a matching circuit 5 for matching impedance between the antenna element and the coaxial transmission line. With such an arrangement, it is possible to obtain an annular antenna element, which realizes a smaller antenna system, while matching impedance between the antenna element and the coaxial transmission line.

However, the conductor plate 6 incorporated in the dielectric plate 1 results in a complex structure of the antenna element 10, and thus a complex manufacturing procedure thereof. In particular, an array antenna, which comprises a plurality of such antenna elements 10, resultantly has an extremely complex structure, since the antenna elements 10 individually have to incorporate a circular conductor plate 6 in the dielectric plate 1.

FIGS. 11A and 11B show a known array antenna system employing microstrip antenna elements, in which a plurality of circular microstrip antenna elements 40 are fed via a circular radial waveguide. In this array antenna system, the microstrip antenna elements 40 each have an off-center feeding point 41, from which a coupling probe 43 extends into the inside of the waveguide 42. When the coupling probes 43 inside the waveguide 42 are positioned in a symmetrical manner with respect to the central axis of the waveguide 42 so as not to disturb traveling waves transmitted inside thereof, because of the off-center location of the feeding point 41, some circular antenna elements 40 are resultantly positioned excessively close to their adjacent antenna elements 40, as indicated by d in an area B of FIG. 11A. Between such adjacent antenna elements, respective antenna elements are strongly coupled to each other, so that characteristics of the whole antenna system are deteriorated.

SUMMARY OF THE INVENTION

The present invention has been conceived to overcome the above problems, and therefore aims to provide an annular microstrip antenna element with a simple structure, which enables impedance matching.

The present invention further aims to provide a radial line antenna system with superior characteristics employing the annular microstrip antenna element of the present invention.

An antenna element of the present invention comprises: a dielectric layer; a ground conductor plate mounted on one surface of the dielectric layer; an annular radiant conductor plate formed on the other surface of the dielectric layer so as to surround a symmetrical area with respect to a predetermined reference line on the surface of the dielectric layer; a feeding point located on the reference line; and a pair of microstrip lines mounted within the area in a symmetrical manner with respect to the reference line, for connecting the feeding point to two points on the annular radiant conductor plate.

According to the present invention, the feeding point is connected via a pair of microstrip lines to the annular radiant conductor plate at two connecting points. With such an arrangement, the input impedance of the annual microstrip antenna element 10 at the feeding point varies depending on the extent of an angle formed by the pair of microstrip lines. In other words, by varying the extent of the angle, it is possible to easily adjust the input impedance of the antenna element 10 so as to match with that of the transmission line, such as a coaxial transmission line feeding a radio frequency power to the antenna element 10. In general, in the case of an antenna element employing an annular radiant conductor plate, the input impedance of the antenna element is higher than that of the coaxial transmission line even when a radio frequency power is fed via the inner edge of the annular radiant conductor plate. In the present invention, however, by simply setting the angle formed by the pair of microstrip lines to a predetermined extent, it is possible to achieve impedance matching between the antenna element and the transmission line without the need to separately provide a circuit for matching impedance. Therefore, the annular microstrip antenna element of the present invention is particularly preferable for use in an array antenna which comprises a plurality of such antenna elements. Moreover, the annual microstrip antenna element of the present invention can be used both for transmitting and receiving signals.

Also, by providing the annular microstrip antenna element with a perturbation segment for removing a degeneracy of modes, it is possible to excite the annular microstrip antenna element with a circularly polarized wave, so that the antenna element of the present invention can be preferably used for transmitting a circularly polarized wave.

Furthermore, by providing a cut-out or a matching conductor, it is possible to achieve a further adjustment of input impedance at the feeding point. With this arrangement, even if the antenna element has a longer feeding pin, for a thicker dielectric layer, and thereby causes a larger reactance, it is possible to achieve impedance matching at the feeding point without deteriorating the radiant efficiency of the antenna element.

Still further, the annular microstrip antenna element of the present invention can have its feeding point at the center of its annular radiant conductor plate. Therefore, in a radial line antenna system comprising a plurality of antenna elements, in which the antenna elements are fed via their respective coupling probes from the radial waveguide, it is possible to mount such antenna elements on concentric circles so that the coupling probes are positioned in a symmetrical manner with respect to the central axis of the radial waveguide. With such an arrangement, since there is a constant space between adjacent antenna elements, it is possible to provide an antenna system with superior characteristics, while reducing disturbance on travelling waves which are transmitted inside the radial waveguide.

DESCRIPTION OF THE PREFERRED EMBODIMENTS

Preferred embodiments of the present invention will next be described with reference to the accompanying drawings.

Embodiment 1.

Figure 1A:
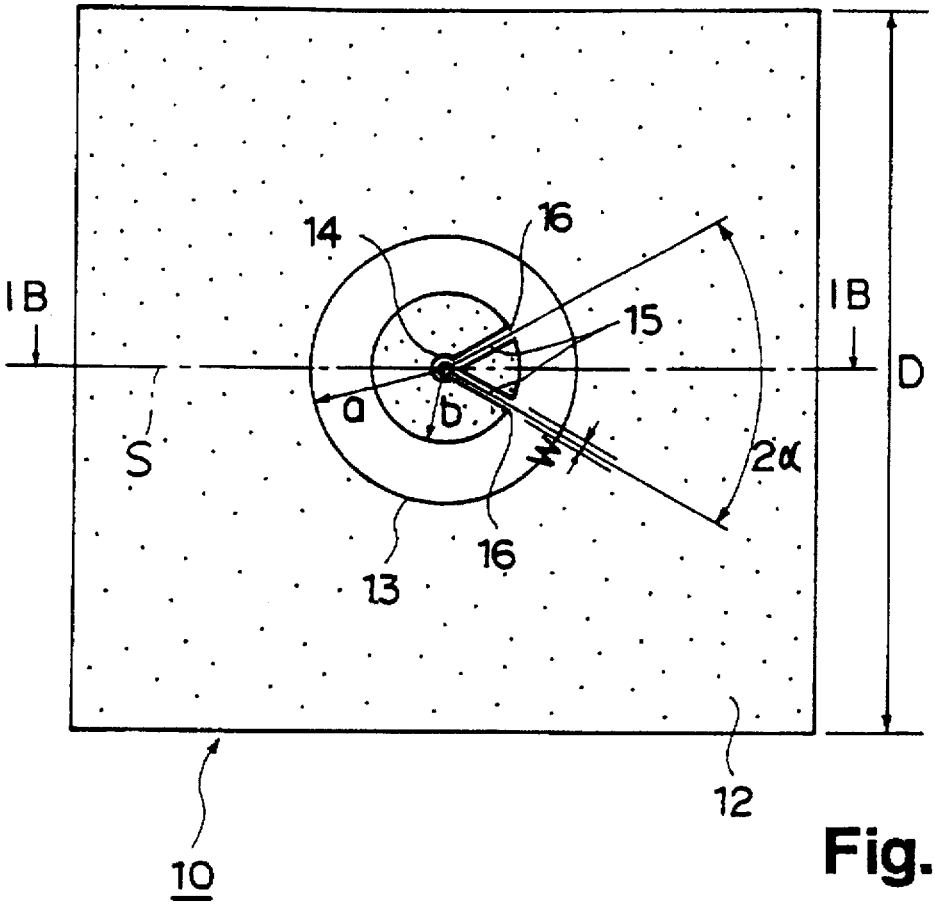
FIG. 1A is a plan view of an annular microstrip antenna element including a radiant conductor plate according to a first embodiment of the present invention.
Figure 1B:
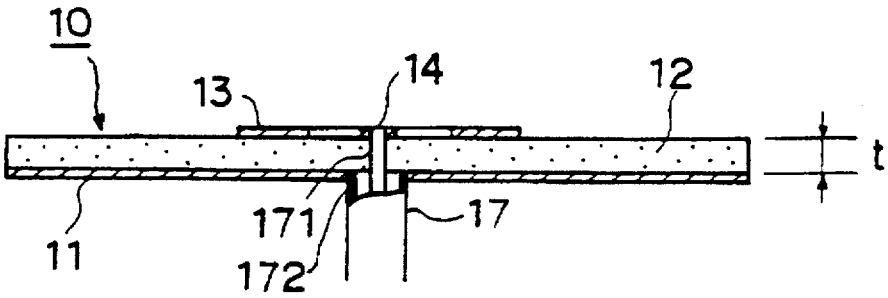
FIG. 1B is a sectional view of the antenna element shown in FIG. 1A.

FIGS. 1A and 1B show a structure of an annular microstrip antenna element 10 according to a first embodiment of the present invention, including a rectangular ground conductor plate 11, a low-loss dielectric layer 12, and an annular radiant conductor plate 13. The conductor plate 13 is mounted on the ground conductor plate 11 via the dielectric layer 12. The dielectric layer 12 may be an air layer such as polystyrene foam.

At the central part of the annular radiant conductor plate 13, a feeding point 14 is formed on a reference line S, which passes through the center of the external shape of the annular radiant conductor plate 13. From the feeding point 14, a pair of microstrip lines 15 extend in a symmetrical manner with respect to the reference line S, together forming a V-like shape, to the inner edge of the annular radiant conductor plate 13 for connection at two connecting points 16. The antenna element 10 is connected to a coaxial transmission line 17, which comprises a central conductor 171 and an external conductor 172. The central conductor 171 is connected to the feeding point 14, while the external conductor 172 is connected to the ground conductor plate 11.

When the annular microstrip antenna element 10 of this embodiment is used in the frequency band of 5 GHz, the side length of the ground conductor plate 11(D), an external diameter of the annular radiant conductor plate 13(*a*), an internal diameter thereof (b), the thickness of the dielectric layer 12(*t*) and the relative permittivity ratio thereof ($\epsilon r$) are respectively defined, for example, as D=60 mm, a=10 mm, b=3.5 mm, t=1.16 mm, and $\epsilon r$=2.6.

Figure 2:
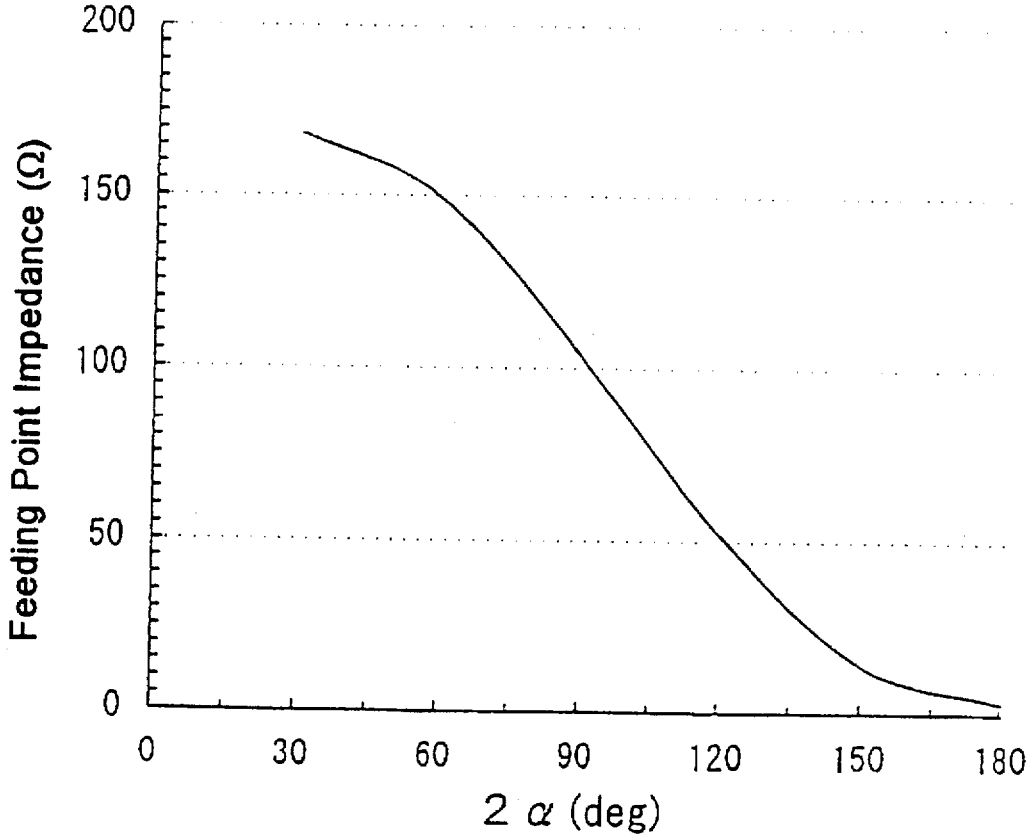
FIG. 2 shows a characteristic relationship between an angle 2α and impedance according to the first embodiment.

As shown in FIG. 1A, when two microstrip lines 15 are connected to two connecting points 16 located in a symmetrical manner with respect to the reference line S, respectively, the impedance of the annular microstrip antenna element 10 at the feeding point 14 comes to be varied by the extent of the angle 2α, which is formed by the pair of the microstrip lines 15. FIG. 2 shows the feeding point 14 impedance of the annular microstrip antenna element 10 with respect to the extent of the angle 2α. This figure shows the impedance characteristic when the width W of the microstrip lines 15 is defined such that the impedance of the line becomes 100Ω. In the case of the present embodiment, the impedance of the annular microstrip antenna element 10 at the feeding point 14 becomes 50Ω, when the extent of the angle 2α is 120°. Then the annular microstrip antenna element 10 has good matching with the generally used coaxial transmission line 17 for feeding a radio frequency power.

Figure 3:
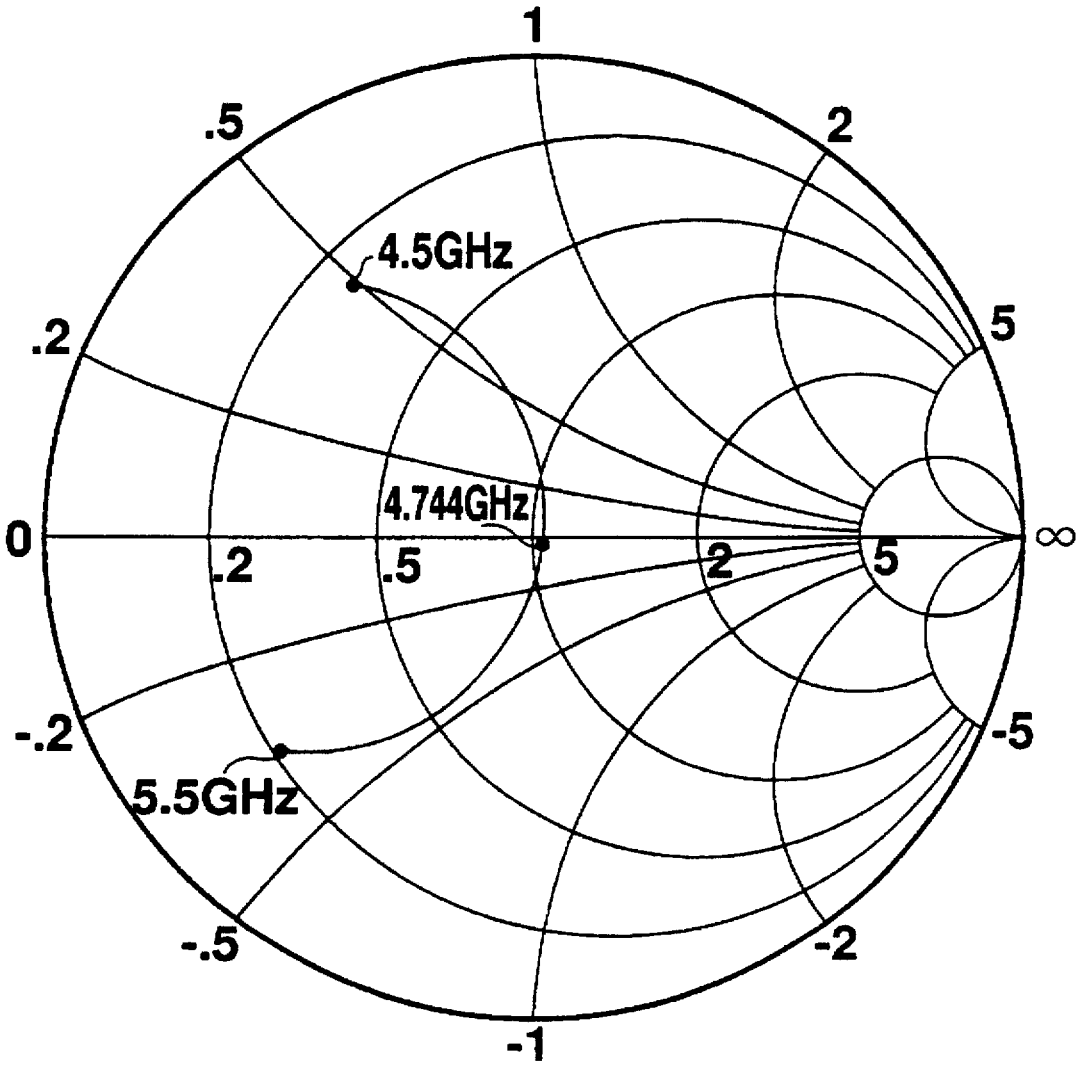
FIG. 3 shows a characteristic relationship between frequency and impedance according to the first embodiment.

FIG. 3 is a Smith Chart showing characteristic impedance with respect to frequency, of the antenna element 10 designed to be used in the frequency band of 5 GHz. According to FIG. 3, the impedance of the antenna element 10 matches that of the coaxial transmission line 17 at somewhere in the region of 4.744 GHz.

Figure 4A:
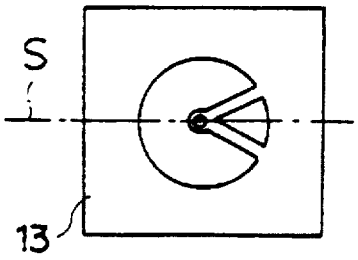
FIGS. 4A, 4B, 4C, 4D and 4E are plan views of other examples of the radiant conductor plate of the annular microstrip antenna element according to the first embodiment.
Figure 4B:
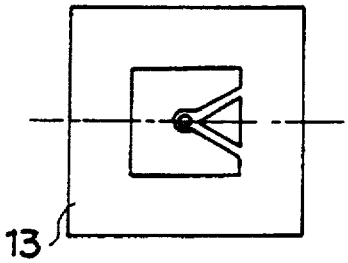
Figure 4C:
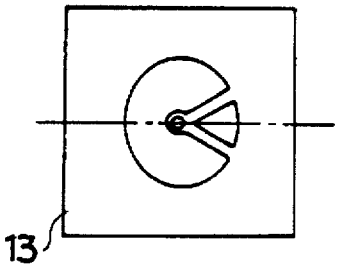
Figure 4D:
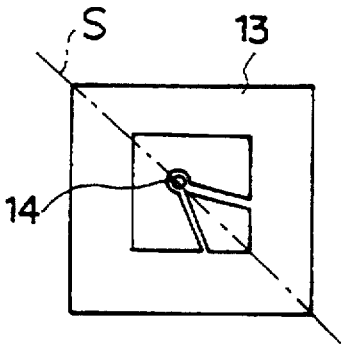
Figure 4E:
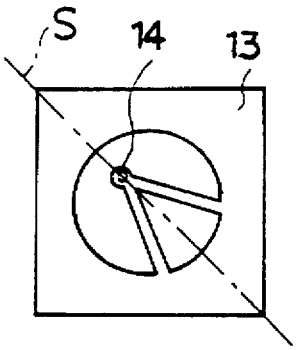

In the above embodiment, as an antenna element to be used for a linear polarization, the radiant conductor plate 13 has round external and internal edges. As shown in FIGS. 4A, 4B, and 4C, however, the radiant conductor plate 13 may also have a rectangular external edge and an internal edge of a round (FIG. 4A), rectangular (square in FIG. 4B), or elliptical (FIG. 4C) shape. Also with such a configuration, it is possible to adjust the input impedance of the antenna element 10 at the feeding point 14 by varying the extent of the angle 2α. Alternatively, as shown in FIGS. 4D and 4E, the reference line S may be a diagonal line of the rectangular radiant conductor plate 13. The examples of FIGS. 4D and 4E each have a feeding point on the reference line S, which is off-center with respect to the external shape of the conductor plate 13. The feeding point 14 may of course be at the center.

As further alternatives, the annular conductor plate 13 may have an elliptical external edge and an internal edge of a round, rectangular, or elliptical shape (not shown).

Embodiment 2.

Figure 5A:
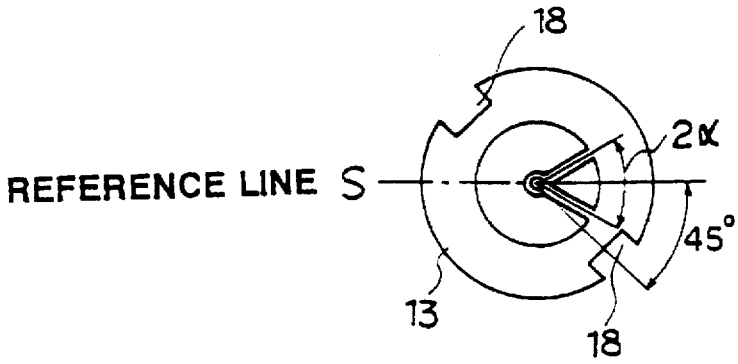
FIGS. 5A and 5B respectively show a radiant conductor plate of an annular microstrip antenna element according to a second embodiment of the invention.
Figure 5B:
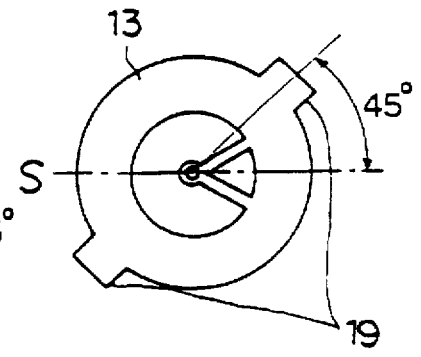

Referring to FIGS. 5A and 5B, a second embodiment of the present invention will next be described. In this embodiment, the annular conductor plate 13 has one or more cut-out(s) 18 (see FIG. 5A) or projection(s) (see FIG. 5B) along its external edge, which serve(s) as a perturbation segment for removing a degeneracy of modes. The cut-out 18 or projection 19 (hereinafter referred to as perturbation segment 18, 19) is provided so as to be aligned in a position 45° or about 45° from the reference line S, the reference line S dividing the angle $2\alpha$ into two identical angles. The radiant conductor plate 13 may have one perturbation segment 18 or 19. More preferably, however, it may have two perturbation segments 18 or 19, situated 180° apart from each other. Alternatively, one radiant conductor plate 13 may have both types of perturbation segments 18 and 19 (one each of two each).

Figure 6:
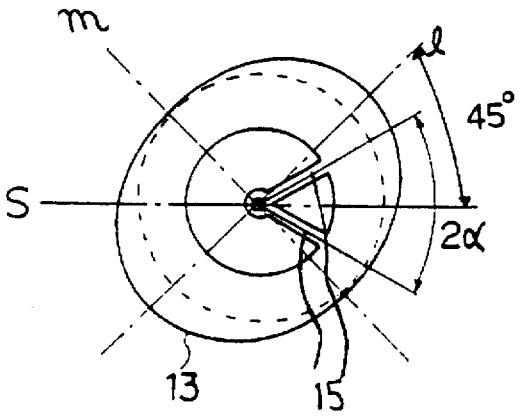
FIG. 6 shows another example of the radiant conductor plate of the annular microstrip antenna element according to the second embodiment.

As described above, since it has a perturbation segment 18 and/or 19, the annular microstrip antenna element 10 of the second embodiment can be used for a circularly polarized wave. The radiant conductor plate 13 shown in FIGS. 5A and 5B has a round external edge. Other than that, it may also have an elliptical external edge and a round internal edge, as shown in FIG. 6, for use in an antenna element for circular polarization. In such an elliptical radiant conductor plate 13, an extended part of the external edge in the direction of the major axis l will serve as the projection 19, while the contracted part in the direction of the minor axis m will serve as the cut-out (or recess) 18. By arranging an angle formed by the major axis l of the radiant conductor plate 13 and the reference line S to be 45° or therearound, it is possible to excite the elliptical radiant conductor plate 13 with a circularly polarized wave.

Embodiment 3.

Figure 7A:
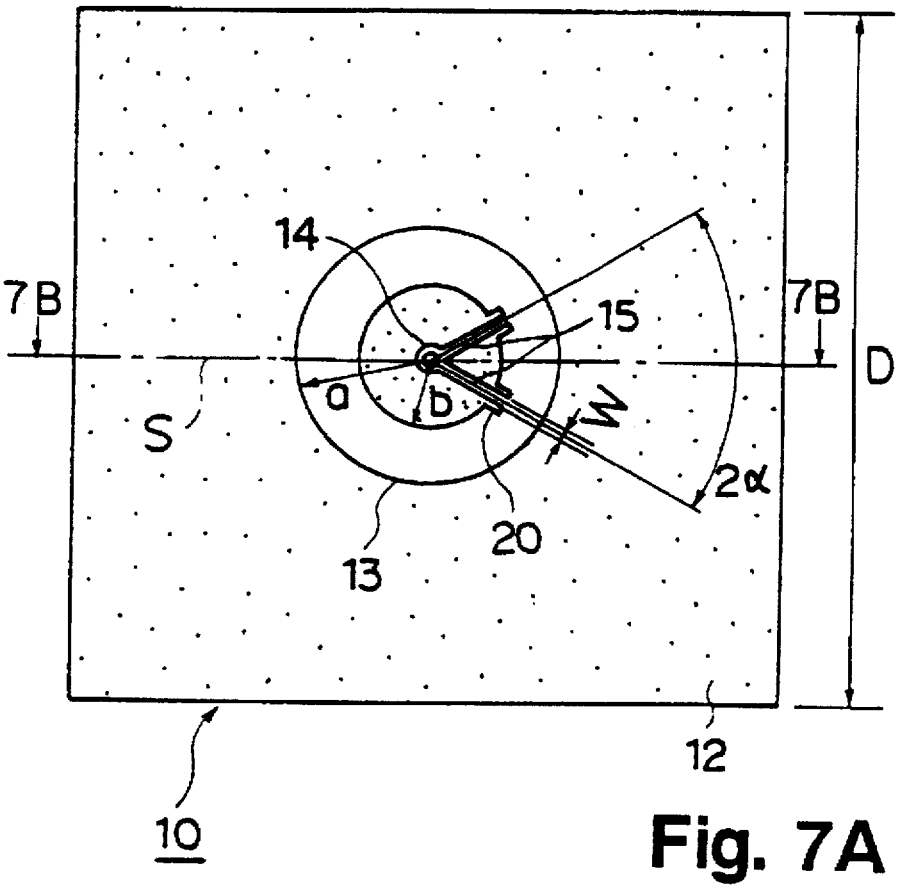
FIG. 7A is a plan view of an annular microstrip antenna element including a radiant conductor plate according to a third embodiment of the present invention.
Figure 7B:
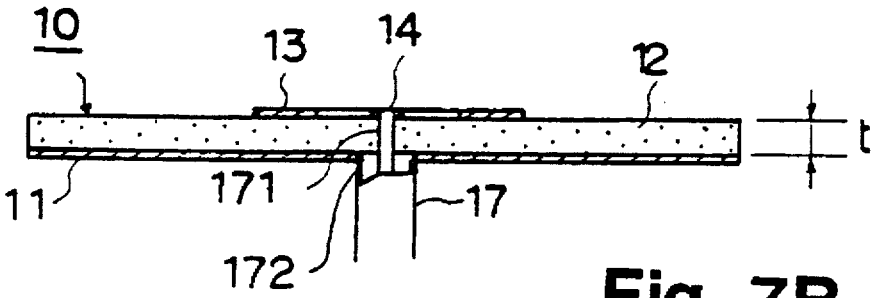
FIG. 7B is a sectional view of the annular antenna element shown in FIG. 7A.

Referring to FIGS. 7A, 7B, 8A and 8B, a third embodiment of the present invention will next be described. FIGS. 7A and 7B show an annular microstrip antenna element 10, in which the annular radiant conductor plate 13 is provided with small cut-outs 20 at the connecting points 16, to which the microstrip lines are connected. The width of the cut-outs 20 is narrower than the width of the microstrip line W. In other words, at each of two points along the inner edge of the annular radiant conductor plate 13, two rectangular cut-outs are formed, one either side of the connecting microstrip line.

Figure 8A:
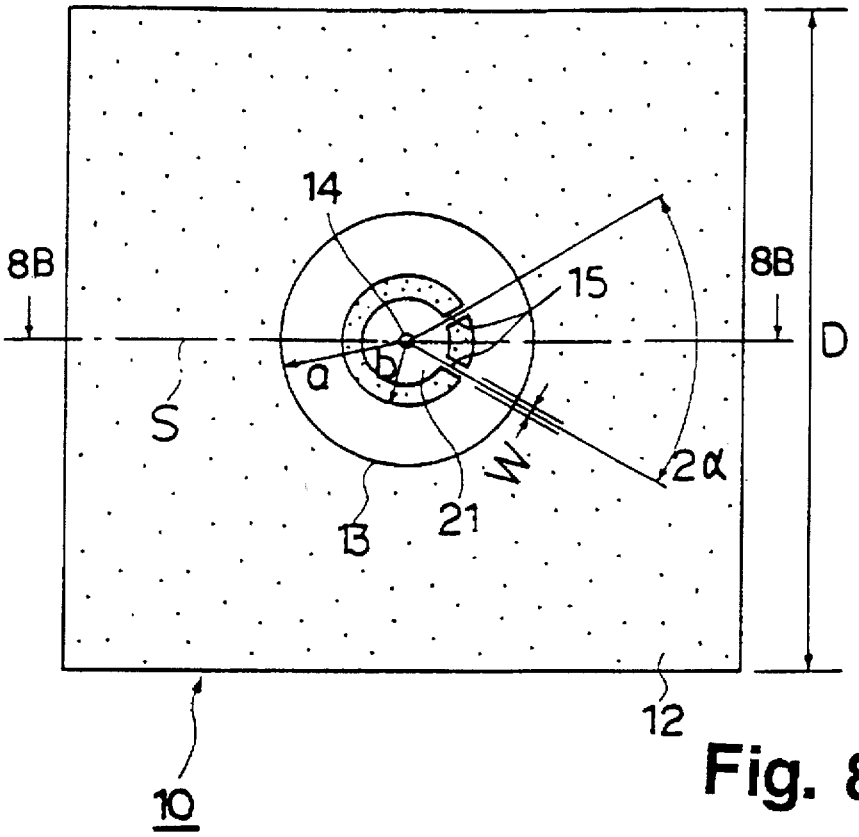
FIG. 8A is a plan view of an annular microstrip antenna element including a modified radiant conductor plate according to the third embodiment.
Figure 8B:
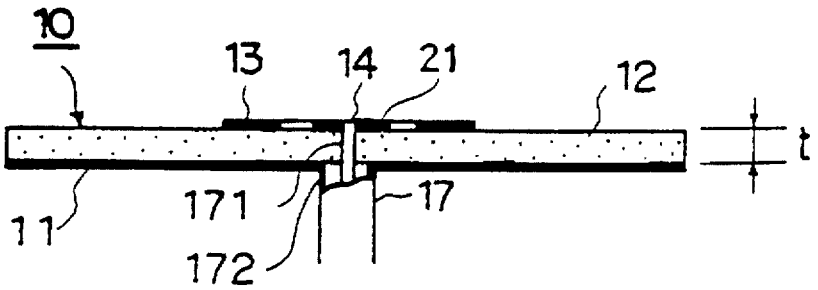
FIG. 8B is a sectional view of the annular microstrip antenna element shown in FIG. 8A.

FIGS. 8A and 8B show an annular microstrip antenna element 10, in which a matching conductor 21 of a flat plate is provided between the feeding point 14 and the radiant conductor plate 13 so as to surround the former without contacting the latter. The matching conductor 21 is a flat circular plate in FIGS. 8A and 8B.

With the above-mentioned arrangement, the input impedance of the radiant conductor plate 13 at the feeding point 14 is variable according to the extent of the cut-out 20 or the matching conductor 21. Therefore, by setting them at a predetermined extent, it is possible to vary the input impedance at the feeding point 14, so as to more easily match with the impedance of the coaxial transmission line 17.

In an example case that the dielectric layer 12 is very thick because of obtaining a wide resonance band, an inductance component of the central conductor 171 (that is, a feeding pin) is not negligible with respect to a radiation resistance component because of the long feeding pin. In such a case, it is possible to compensate the inductance component by utilizing the cut-out 20 or the matching conductor 21 of the third embodiment. Then, good matching with the feeding cable and high radiation efficiency can be obtained. The cut-out (recess) 20 and the matching conductor 21 are particularly effective for subtle adjustment of a finished annular microstrip antenna element 10.

Embodiment 4.

Figure 9A:
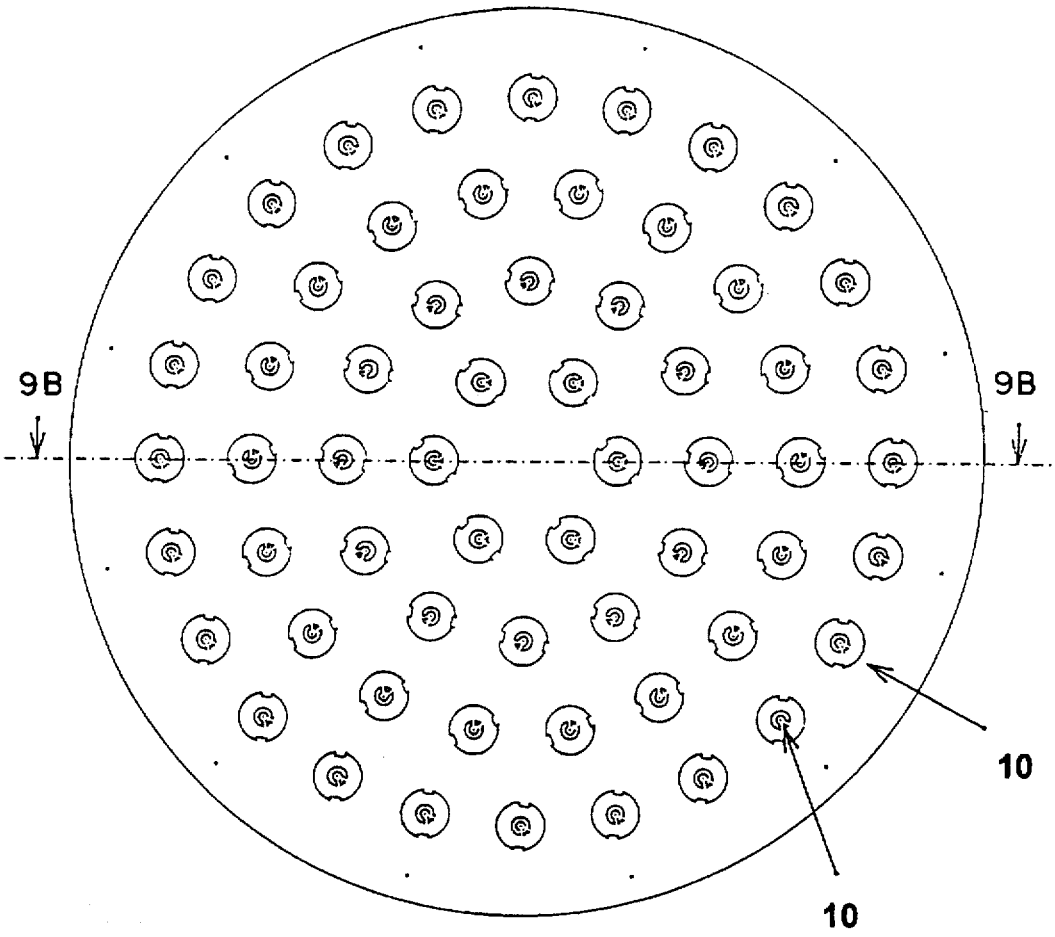
FIG. 9A is a plan view of a radial line antenna system according to a fourth embodiment of the present invention.
Figure 9B:
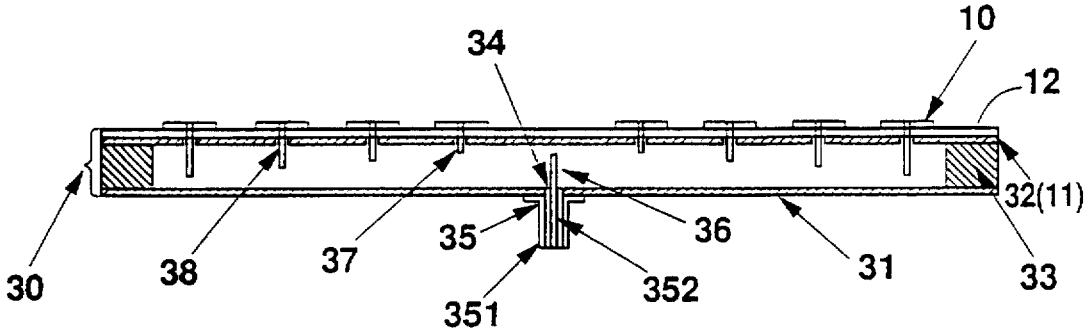
FIG. 9B is a sectional view of the antenna system shown in FIG. 9A.
Figure 10A:
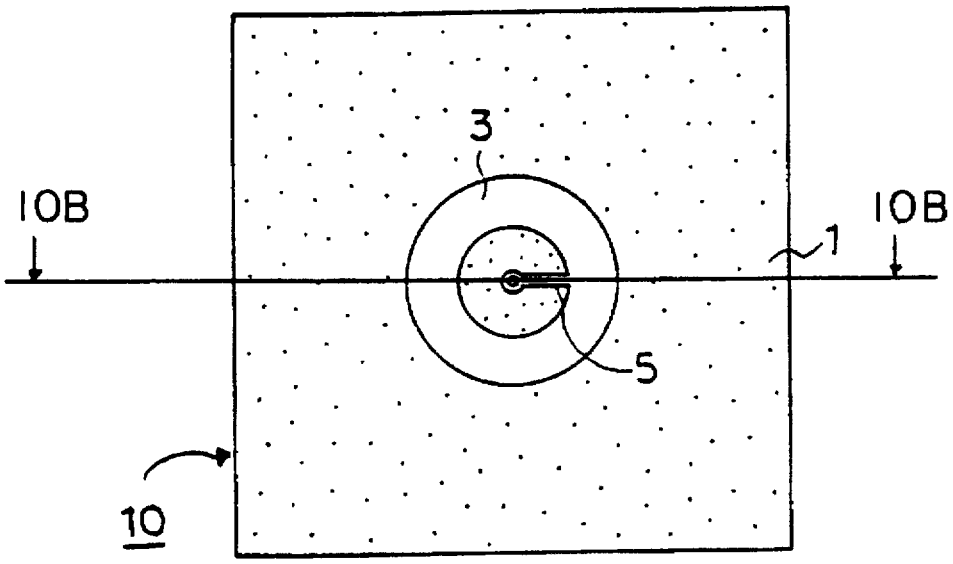
Fig. 10A PRIOR ART
FIG. 10A is a plan view of a conventional annular microstrip antenna element.
Figure 10B:
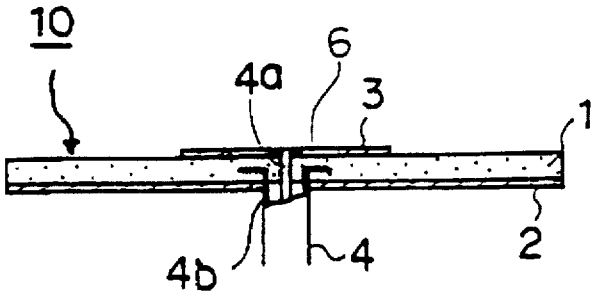
Fig. 10B PRIOR ART
FIG. 10B is a sectional view of the antenna element shown in FIG. 10A.

Referring to FIGS. 9A and 9B, a fourth embodiment of the present invention will next be described. FIG. 9A is a front plan view of a radial line antenna system employing the annular microstrip antenna element according to the present invention. FIG. 9B is a sectional view along line A—A of the antenna system shown in FIG. 9A. The radial line antenna system in this embodiment comprises a radial waveguide 30 and one or more annular microstrip antenna element(s) 10. In FIG. 9A, sixty annular microstrip antenna elements 10 are mounted on a circular radial waveguide 30.

Figure 11A:
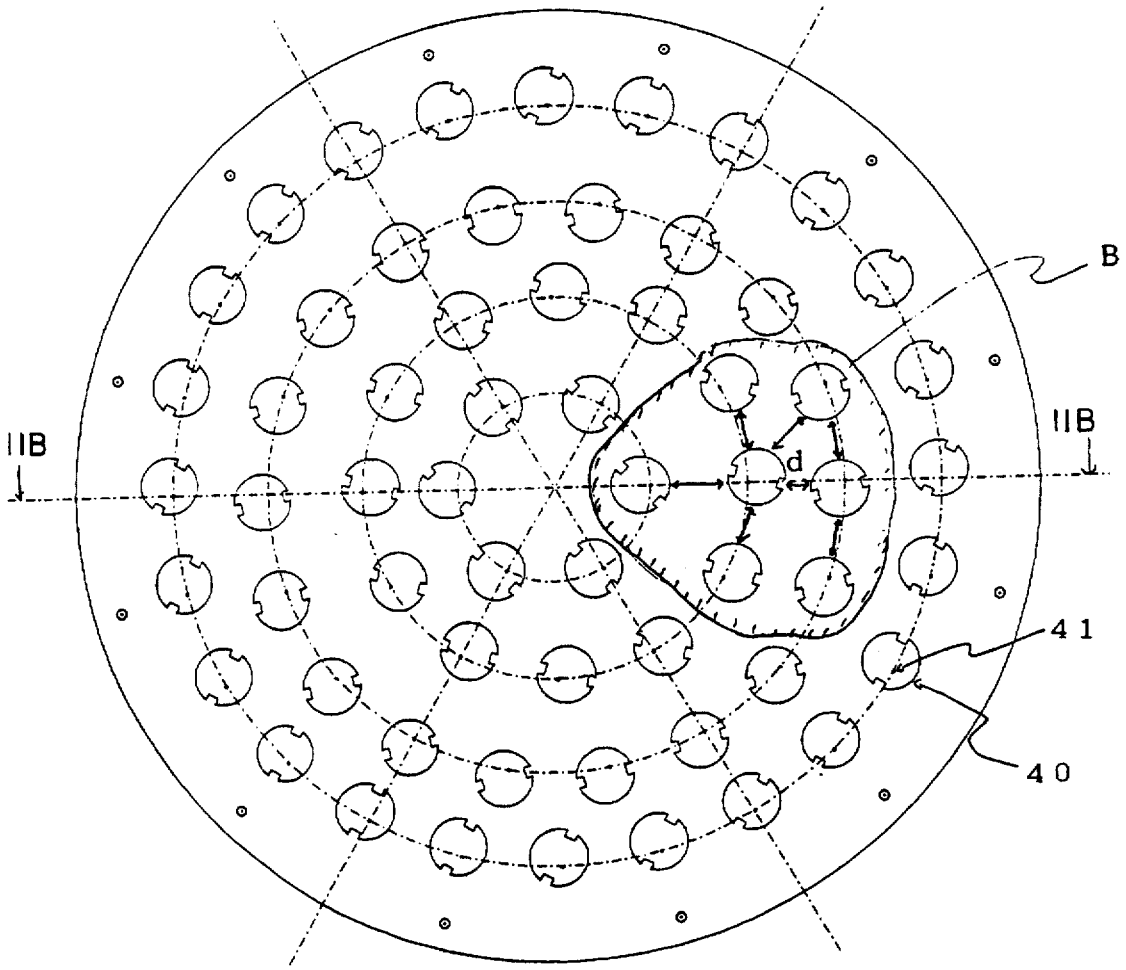
Fig. 11A PRIOR ART
FIG. 11A is a conventional array antenna system.
Figure 11B:
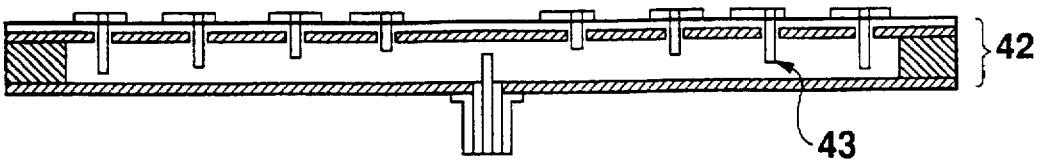
Fig. 11B PRIOR ART
FIG. 11B is a sectional view of the antenna system shown in FIG. 11A.

As known from a prior art such as is shown in FIG. 11, the radial waveguide 30 comprises a circular lower metallic plate 31, a circular upper metallic plate 32, and a side metallic plate 33. The upper metallic plate 32 is positioned above and parallel to the lower metallic plate 31, with some space between them, the space being small relative to the wavelength of a transmission wave. The side metallic plate 33 shorts the upper and lower circular metallic plates 32 and 31 together at their edges.

As shown in FIG. 9B, the lower metallic plate 31 has an aperture 34 at its center, into which a coaxial transmission line 35 is inserted, the coaxial transmission line 35 including an external conductor 351 and a central conductor 352. In this embodiment, the insertion section around the aperture 34 has a coaxial connector structure, where the external conductor 351 is connected to the lower metallic plate 31, and the central conductor 352 is inserted into the radial waveguide 30, so as to form a feeding probe 36.

Meanwhile, every annular microstrip antenna element 10 has a coupling probe 37, which extends downward from the feeding point 14, penetrating the dielectric layer 12, the ground conductor plate 11, and the upper metallic plate 32. In this embodiment, the part of the coupling probe 37 which penetrates the dielectric layer 12 is particularly referred to as a feeding pin. A feeding pin corresponds to a central conductor 171 of a coaxial transmission line according to the first to third embodiments. In FIG. 9B, the ground conductor plate 11, which serves as an upper metallic plate 32 as well, and the dielectric layer 12 are a single plate or layer, respectively, common to all annular microstrip antenna elements 10 mounted thereon. In order to prevent the coupling probe 37 from contacting the upper metallic plate 32 (that is, the conductor plate 11), the upper metallic plate 32 (that is, the conductor plate 11) has small holes 38, through each of which the coupling probe 37 penetrates to be inserted into the radial waveguide 30. The annular microstrip antenna elements 10 have an unillustrated cut-out or cut-outs 20 (or a matching conductor or matching conductors 21) of the third embodiment in order to obtain an impedance matching corresponding to the ratio of the length to a diameter of the feeding pin which penetrates the dielectric layer 12. Alternatively, the upper metallic plate 32 and the ground conductor plate 11 of the microstrip antenna element 10 may be separate plates.

The length of respective coupling probes 37, which extend inside the radial waveguide 30, is determined such that the antenna element 10 positioned radially further from the feeding probe 36 has a longer coupling probe 37, as shown in FIG. 9B. With such an arrangement, every annular microstrip element is excited to an equal amplitude by the coupling probes 37 inserted into the radial waveguide.

In such a radial line antenna system, an electromagnetic wave having a TEM mode (a mode having no component in a guided wave direction) is supplied from the coaxial transmission line 35 to the radial waveguide 30 via the feeding probe 36. In the radial waveguide 30, the fed electromagnetic wave is radially transmitted in the form of a cylindrical wave, from the center of the radial waveguide 30 to the respective coupling probes 37 for excitation of respective annular microstrip antenna elements 10.

In the present embodiment, since the annular microstrip antenna element 10 has its feeding point at its center, it is possible to position the antenna elements 10 along concentric circles on the radial waveguide 30 such that respective coupling probes 37 are located in a symmetrical manner with respect to the central axis of the radial waveguide 30. With this arrangement, since every antenna element 10 is resultantly positioned having a constant space between adjacent antenna elements 10, while reducing disturbance on travelling waves, which are transmitted inside the radial waveguide 30, it is possible to provide a radial antenna system with superior characteristics.

What is claimed is:

1. An annular microstrip antenna element, comprising:

(a) a dielectric layer;

(b) a ground conductor plate mounted on one surface of the dielectric layer;

(c) an annular radiant conductor plate formed on the other surface of the dielectric layer so as to surround an area which is symmetrical with respect to a predetermined reference line on the surface of the dielectric layer;

(d) a feeding point located on the reference line; and (e) a pair of microstrip lines mounted within the area in a symmetrical manner with respect to the reference line, for connecting the feeding point to two connecting points on an inner edge of the annular radiant conductor plate.

2. An annular microstrip antenna element according to claim 1, wherein the pair of microstrip lines extend together forming a V-like shape, for connecting the feeding point to the two points on the inner edge of the annular radiant conductor plate.

3. An annular microstrip antenna element according to claim 2, wherein the pair of microstrip lines define an angle of the V-like shape, such that input impedance of the microstrip antenna element at the feeding point matches impedance of a transmission line for feeding a radio frequency power.

4. An annular microstrip antenna element according to claim 1, wherein the annular radiant conductor plate is equipped with a perturbation segment for removing a degeneracy of modes, which has been formed by modifying a part of the annular radiant conductor plate.

5. An annular microstrip antenna element according to claim 4, wherein the perturbation segment is a recess, which has been formed by indenting an external edge of the annular radiant conductor plate.

6. An annular microstrip antenna element according to claim 4, wherein the perturbation segment is a projection, which has been formed by protruding an external edge of the annular radiant conductor plate.

7. An annular microstrip antenna element according to claim 4, wherein an external edge of the annular radiant conductor plate is of an elliptical shape.

8. An annular microstrip antenna element according to claim 1, wherein the annular radiant conductor plate is provided with cutouts in an external direction in areas around the respective two connecting points between the two microstrip lines and the annular radiant conductor plate.

9. An annular microstrip antenna element according to claim 1, wherein a matching conductor plate is provided so as to surround the feeding point without contacting the annular radiant conductor plate.

10. A radial line antenna system comprising:

a radial waveguide including a pair of conductor plates situated opposite to each other with some space there between, the space being small relative to a wavelength of an electromagnetic wave to be transmitted, for transmitting the electromagnetic wave from a central part of the radial waveguide to a peripheral part of the radial waveguide, a plurality of annular microstrip antenna elements formed on an outer surface of one of the pair of conductor plates, said plurality of annular microstrip antenna elements are disposed having equal spaces between them, connecting means for connecting the annular microstrip antenna element and the radial waveguide by electromagnetic coupling, feeding means for connecting the coaxial transmission line and the radial waveguide by electromagnetic coupling, wherein the annular microstrip antenna element comprises, (a) a dielectric layer, (b) a ground conductor plate mounted on one surface of the dielectric layer, (c) an annular radiant conductor plate formed on the other surface of the dielectric layer so as to surround an area which is symmetrical with respect to a predetermined reference line on the surface of the dielectric layer, (d) a feeding point located on the reference line, and (e) a pair of microstrip lines mounted within the area in a symmetrical manner with respect to the reference line, for connecting the feeding point to two connecting points on an inner edge of the annular radiant conductor plate.

11. The antenna system of claim 10, wherein the annular radiant conductor plate is equipped with a perturbation segment for removing a degeneracy of modes, which has been formed by modifying a part of the annular radiant conductor plate.

* * * * *